United States Patent [19]

Molaire et al.

[11] Patent Number: 4,473,626

[45] Date of Patent: Sep. 25, 1984

[54] ELECTROHARDENABLE MATERIALS FOR PHOTOELECTROPHORETIC IMAGING

[75] Inventors: Michel F. Molaire; Paul L. Nielsen; Orville C. Rodenberg, all of Rochester, N.Y.

[73] Assignee: Eastman Kodak Company, Rochester, N.Y.

[21] Appl. No.: 488,297

[22] Filed: Apr. 25, 1983

[51] Int. Cl.[3] ..... G03G 17/04

[52] U.S. Cl. ..... 430/32; 430/35; 204/181 E

[58] Field of Search ..... 430/52, 66, 33, 35, 430/32; 204/181 R, 181 E

[56] References Cited

U.S. PATENT DOCUMENTS 3,436,215 4/1969 Levinos et al. ..... 430/52

FOREIGN PATENT DOCUMENTS 1205438 9/1970 United Kingdom .

*Primary Examiner*—John E. Kittle
*Assistant Examiner*—John L. Goodrow
*Attorney, Agent, or Firm*—Torger N. Dahl

[57] ABSTRACT

Electrically photosensitive materials comprising electrically photosensitive colorant particles dispersed in a liquefiable, electrically insulating carrier containing a binder polymer and electropolymerizable bisphenol-acrylate monomers or mixtures of such monomers are disclosed. The disclosed materials are employed in photoelectrophoretic processes wherein the colorant particles are caused to migrate by the action of light and an electric field, while the material is electrohardened by the electric field.

17 Claims, No Drawings

ELECTROHARDENABLE MATERIALS FOR PHOTOELECTROPHORETIC IMAGING

This invention relates to electrically photosensitive imaging materials containing an electrically photosensitive colorant dispersed in a liquefiable carrier containing components which harden under the influence of an electrical field.

In photoelectrophoretic imaging processes, an imaging layer comprising an electrically photosensitive material is placed between two electrodes, subjected to the influence of an electric field and exposed to an image pattern of electromagnetic radiation to which the electrically photosensitive material is sensitive. This causes electrically photosensitive colorants in the material to migrate imagewise in the layer to form a record of the imaging electromagnetic radiation.

After particle migration, however, the imaging material is relatively soft and thus susceptible to abrasion or scratching. To some extent, the problem is alleviated by overcoating the material with a protective layer of sufficient hardness to resist physical abuse. The additional layer, however, adds to the thickness, complexity and cost of the resulting imaging-bearing material.

In accordance with the present invention, an electrically photosensitive material is provided which comprises particles of an electrically photosensitive colorant dispersed in a liquefiable, electrically insulating carrier containing a polymeric binder and an electropolymerizable monomer. The electropolymerizable monomer employed is a bisphenol-acrylate monomer. By "bisphenol-acrylate" we mean the ester condensation product of a bisphenol and at least one acrylic monomer such as acrylic acid or methacrylic acid. The monomer corresponds to Structure I:

I

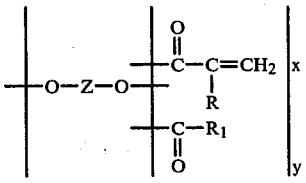

wherein:

Z, together with the oxygen atoms to which it is attached, is the residue of a bisphenol;

R is hydrogen or methyl;

$R_1$, together with the:

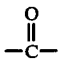

to which it is attached, is an acyl group;

x is 1 or 2;

y is 0 or 1; and x+y is 2;

Preferred monomers employed in the present invention correspond to Structure II:

II

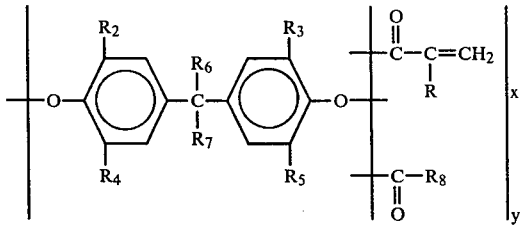

wherein:

R, x and y are as defined above;

$R_8$ is 1–6 carbon alkyl or cycloalkyl, phenyl, benzyl, halogenated phenyl or halogenated benzyl;

each of $R_2$, $R_3$, $R_4$ and $R_5$ is independently 1–4 carbon alkyl or halogen; and each of $R_6$ and $R_7$ is independently hydrogen, 1–6 carbon alkyl or, when taken together with the carbon atom to which they are attached, form a divalent, monocyclic or polycyclic aromatic, alicyclic or heterocyclic group such as benzo[d]furan-3-on-1-ylidene, 4,7-methanohexahydroindan-5-ylidene or 9-fluorenylidene.

Electropolymerizable monomers which are useful in the present invention are described as unsaturated, multifunctional organic monomers in British Pat. No. 1,205,438 published Sept. 16, 1970, the disclosure of which is incorporated herewith by reference.

The electropolymerizable monomers employed in the electrically photosensitive materials of the present invention can be prepared by condensing a bisphenol with one or more acid chlorides to give the Structure I compound or mixture of such compounds. In mixtures of the polymerizable compounds, at least half of the available bisphenol hydroxy functional groups are condensed with an acrylic or methacrylic acid chloride. At least 10 mole percent, however, of the remaining hydroxy sites are preferably condensed with an acid chloride of the type:

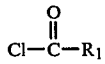

where $R_1$ is as defined above. Such mixtures will be characterized by the mole percentage of each type of acid chloride employed based on the total moles of all acid chlorides employed in the condensation reaction.

Representative electropolymerizable monomers include the following:

A.

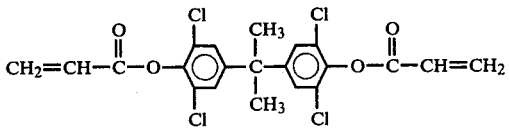

4,4'-isopropylidenebis(2,6-dichlorophenylene) diacrylate

B.

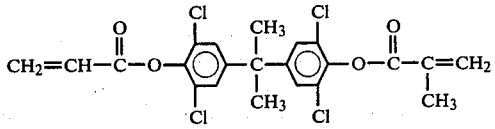

4,4'-isopropylidenebis(2,6-dichlorophenylene) monoacrylate:monomethacrylate

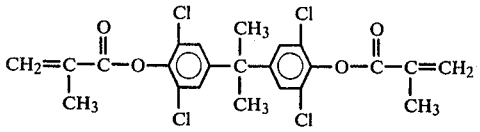

C.

4,4'-isopropylidenebis(2,6-dichlorophenylene) dimethacrylate

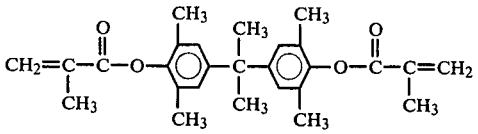

D.

4,4'-isopropylidenebis(2,6-dimethylphenylene) dimethacrylate

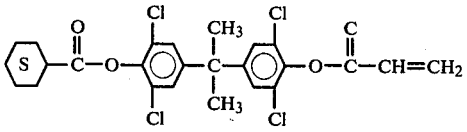

E.

4,4'-isopropylidenebis(2,6-dichlorophenylene) monocyclohexanecarboxylate:monoacrylate

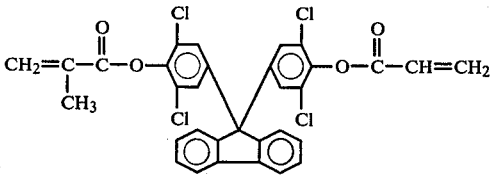

F.

4,4'-(9-fluorenylidene)bis(2,6-dichlorophenylene) monoacrylate:monomethacrylate

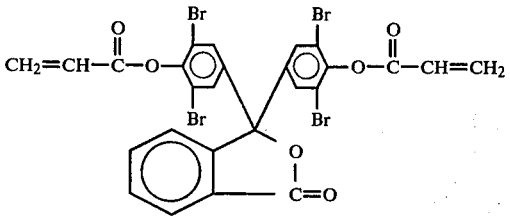

G.

4,4'-[benzo[d]furan-3-on-1-ylidene]bis(2,6-dibromophenylene) diacrylate

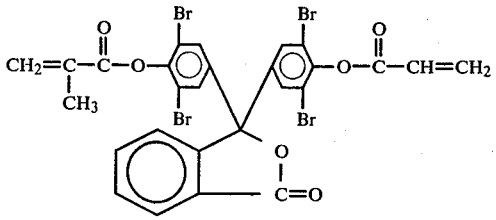

H.

4,4-[benzo[d]furan-3-on-1-ylidene]bis(2,6-dibromophenylene) monoacrylate:monomethacrylate The electrically insulating carrier employed in our invention contains at least one polymeric binder. The polymer(s) selected, together with the electropolymerizable monomer (i.e., the carrier), must be electrically insulating, as well as liquefiable. We have found, for example, that only if the carrier conductivity is less than $1\times10^{-10}$ (ohm cm)$^{-1}$ will the electrically photosensitive colorants dispersed in the carrier migrate toward an electrode under the combined influence of an electrical field and actinic radiation. Furthermore, unlike known electropolymerizable processes such as disclosed in British Pat. No. 1,205,438, the process of electric-field hardening the electropolymerizable monomers in our materials does not occur without electrically photosensitive colorant particles. We believe, in this regard, that the presence of such electrically photosensitive colorant particles compensates for the low conductivity of the electrically insulating carrier in promoting field-induced polymerization.

Polymeric binders which are useful in forming a component of the carrier can vary widely from among known liquefiable, electrically insulating polymers. In preferred carriers, moreover, the binder polymers and electropolymerizble monomers are selected so as to be sufficiently physically compatible in the liquid and solid states to achieve minimum optical density variations within the carrier, as well as fewer large-particle colorant domains in the carrier. Absent such compatibility, mottled or grainy images can result.

Particularly useful binder polymers are long-hydrocarbon-chain acrylate or methacrylate polymers, polyesters of long-chain aliphatic diols and diacids having the structure:

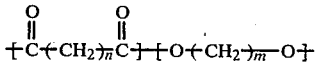

wherein n and m are the same or different integers of 11 or greater; polyvinyl esters derived from long-chain aliphatic acids; and polyolefins or polystyrene. Representative useful polymers include the following:

poly(docosyl acrylate)
poly(docosyl acrylate-co-methyl acrylate 60/40)
poly(docosyl acrylate-co-methyl acrylate 50/50)
poly(vinyl stearate)
poly(octadecyl acrylate)
poly(hexadecamethylene hexadecanedioate)
poly(vinylphenyl stearate)
poly(vinylphenyl methacrylate-co-vinylphenyl stearate 50/50)
poly[4,4'-isopropylidenebis(2,6-dichlorophenylene) undecanedioate]
poly(vinylphenyl methacrylate-co-vinylbenzylmyristate) 45/55

Other useful addenda in the carrier include long-hydrocarbon-chain diesters such as bisdocosyl adipate, bisdocosyl succinate, bisoctadecyl adipate, bistetradecyl adipate and bisoctadecyl succinate, as well as long-hydrocarbon-chain acrylate or methacrylate monomers such as docosyl acrylate or docosyl methacrylate.

Carriers employed in the electrically photosensitive material of the invention are liquefiable; during use, that is, they should be capable of becoming liquid or partially liquid, such as by solvent treatment or by the application of heat, preferably the latter. Carriers which are liquefiable by heat should remain solid up to about 50° C. and be totally liquid at 100° C., so as to permit colorant migration during imaging.

The electrically photosensitive materials of the present invention preferably have a glass transistion temperature (Tg) exceeding 50° C. to aid in maintaining cohesive strength during storage to prevent blocking. Mixtures of the polymerizable monomers, moreover, are preferred in the materials to minimize or prevent such monomers from crystallizing.

The electrically photosensitive materials of this invention also comprise electrically photosensitive colorant particles. Such colorants are described in detail in the patent literature relating to photoelectrophoretic imaging or migration imaging. Useful colorants include the colorants described in U.S. Pat. No. 4,145,215 issued Mar. 20, 1979, to J. A. VanAllan et al, particularly the colorants described in Table IV, columns 16–19; merocyanine-cyanine-merocyanine colorants described in International Publication Number WO 83/00752 published Mar. 3, 1983; and composite electrically photosensitive colorants described in *Research Disclosure,* Vol. 190, February, 1980, item 19014 entitled "Composite Electrically Photosensitive Particles" (published by Industrial Opportunities Ltd., Homewell, Havant, Hampshire, PO9 1EF, UK).

The amount of colorant employed will vary but, as noted, electropolymerization of the above monomers requires the colorant particles. Concentrations of at least 0.05 part colorant for each 10 parts carrier will provide useful hardening in an electrical field, as well as sufficient color image density. Concentrations of 2.0 and higher parts colorant per 10 parts carrier are also useful. The average particle size of the colorant can also vary. An average particle size within the range from about 0.01 micrometers (μm) to about 20 μm is useful, preferably from about 0.01 to about 5 μm.

The materials described herein are employed in photoelectrophoretic (PEP) imaging processes which require the combined action of an electric field and exposure to an image pattern of electromagnetic radiation to obtain an image and in which it is desirable to have a hardening effect after the imaging sequence.

In one PEP imaging process, the liquefied, electrically photosensitive imaging material is positioned between two spaced electrodes. While so positioned between the spaced electrodes, the imaging layer is subjected to an electric field and exposed to an image pattern of activating radiation. As a consequence, the charge-bearing, electrically photosensitive colorant particles in the imaging layer migrate to one or the other of the electrode surfaces to form on at least one of the electrodes an image record representing a positive-sense or negative-sense image of the original image pattern. The image record is developed by separation of the electrodes. In this process, the layer of electrically photosensitive material may be sandwiched between two support sheets to form an imaging element. After application of the field and exposure, a visual record of the image pattern is developed on at least one of the two sheets by separation of the sheets. The support sheets may be electrodes, or electrodes may be directly attached to the back surfaces of the support sheets. Alternatively, one or both of the support sheets may be made of a conductive material. In some embodiments, at least one of the sheets is transparent or translucent so as to permit exposure of the imaging layer.

In a preferred embodiment, a layer of the electrically photosensitive material on an electrode constitutes what is referred to as a donor element, which is placed in contact with a receiver element comprised of one or more receiving layers on a second electrode. The receiving element and donor element in this embodiment are in contact so that, after imaging and separation of the two elements, a negative image is formed on one element and a positive image on the other. A particularly useful receiving element—which is sometimes referred to as a blocking electrode—comprises a layer containing a finely divided ferroelectric material, such as zinc oxide or titanium dioxide, dispersed in a polymeric material, such as a polyester, polyether or polyurethane, coated on a conductive substrate. Such blocking electrodes are disclosed in U.S. Pat. No. 3,859,576 issued Jan. 7, 1975, to A. C. Sheckler et al. Preferably the ferroelectric-polymeric material layer is overcoated with a polymeric layer to protect against abrasion and minimize the effect of changes in humidity. Useful overcoat polymers include cellulose esters, polymers of alkyl methacrylates or alkyl acrylates, vinyl polymers and polyesters.

In the foregoing process, the carrier in the imaging layer of electrically photosensitive material is at least partially liquid during imaging. "Partially liquid" is used herein to mean that the cohesive forces of the materials forming the layer are sufficiently weakened to permit some imagewise migration of the colorant, under the combined influence of light exposure and an electric field, in the layer of electrically photosensitive material.

Charge-control agents may be incorporated to improve the uniformity of charge polarity of the electrically photosensitive colorant particles. Charge-control agents preferably are polymers and are incorporated in the electrically photosensitive materials by admixture with the carrier.

In addition to enhancement of uniform charge polarity, the charge-control agents often provide more stable suspensions, i.e., suspensions which exhibit substantially less settling out of the dispersed photosensitive particles.

Charge-control agents include those disclosed in U.S. Pat. Nos. 4,219,614 and 4,273,849, examples of which are poly(vinyltoluene-co-lauryl methacrylate-co-lithium methacrylate-co-methacrylic acid), poly(styrene-co-lauryl methacrylate-co-lithium sulfoethyl methacrylate), poly(vinyltoluene-co-lauryl methacrylate-co-lithium methacrylate), poly(t-butylstyrene-co-lauryl methacrylate-co-lithium methacrylate-co-methacrylic acid), poly(t-butylstyrene-co-lithium methacrylate) or poly(t-butylstyrene-co-methacrylic acid-co-lithium methacrylate).

Sensitizers can also be incorporated into the electrically photosensitive materials to increase the electrical photosensitivity of the colorants. Useful sensitizers include polyarylamine compounds such as poly(alkoxyaryl)amines as described in U.S. Pat. No. 4,258,112 issued Mar. 24, 1981, to J. Y. Kaukeinen.

Imaging elements comprising layers of the electrically photosensitive material of this invention are made according to well-known techniques. The elements may be formed simply by dispersing the electrically photosensitive material in an electrically insulating liquefied carrier and coating the resulting suspension or dispersion on a support according to well-known coating techniques.

A typical apparatus for carrying out a PEP imaging process is shown in the Figure of U.S. Pat. No. 4,331,751 issued May 25, 1982, to H. V. Isaacson et al, the disclosure of which is incorporated herein by reference.

As previously indicated, the electrically photosensitive materials of the invention contain electropolymerizable monomers which harden under the influence of an electric field. The degree of such hardening can vary depending on the concentration of such monomers, as well as the duration and intensity of the applied field. The extent of hardening is determined by measuring either the scratch resistance in image areas of the material or the decrease in solubility of the layer after imaging and hardening.

It will be appreciated that the present materials are influenced in two different ways by an electrical field. In particular, an electrical field stimulates both colorant migration (in exposed regions) and electrohardening (an overall effect not limited to image regions). Accordingly, it is important to expose the material imagewise and permit field-induced migration before the material hardens excessively to prevent such migration. Generally, this is accomplished by imagewise-exposing the material to actinic radiation before, during, or as soon after application of the field as possible. Preferably, imagewise exposure should commence within 0.5 second after field application.

In this regard, we have found simultaneous exposure and field application for about 1 second, followed by an additional field application for about 1 second, to produce both useful hardening and imaging results.

The current density, in microamperes per centimeter$^2$ ($\mu A/cm^2$) necessary to produce useful hardening of our materials can vary widely. Generally, a current density of at least 0.2 $\mu A/cm^2$ in an electric field of at least $6\times(10)^4$ volts/cm is sufficient to increase image scratch resistance. Preferably, the current density is at least 0.6 $\mu A/cm^2$. The duration of electric-field exposure to such current densities can also vary but in general at least 0.2 second is useful with preferred results occurring in at least 1.0 second.

In addition to being electrohardenable, the monomers employed in our material are photopolymerizable in the presence of suitable curing photosensitizers and activators. Accordingly, another embodiment of our invention comprises the incorporation of a photosensitizer and activator to provide photohardenability in addition to electrohardening. In this regard, the activating radiation for photohardening is in a wavelength such as ultraviolet which is not employed in the exposure step so that photohardening does not take place during imagewise exposure.

Addenda which can be incorporated into the material to promote UV hardening include 3-benzoyl-5,7-di-n-propoxycoumarin or 3-(2-benzofuroyl)-7-diethylaminocoumarin) photosensitizer, in combination with ethyl 4-dimethylaminobenzoate activator or any of the coinitiator combinations disclosed in U.S. Pat. No. 4,289,844.

The following preparations and examples are provided to aid in the practice of the present invention.

PREPARATION OF ELECTROPOLYMERIZABLE MONOMERS OR MONOMER MIXTURES

Preparation A 4,4'-isopropylidenebis(2,6-dichlorophenylene) dimethacrylate

In a 100-mL, three-neck, round-bottomed flask, 51.25 g (0.14 mole) of 4,4'-isopropylidenebis(2,6-dichlorophenol) were dissolved in 200 mL of 1,2-dichloroethane. An amount of 29.5 g (0.29 mole) triethylamine was added and the mixture stirred magnetically. A quantity of 29.27 g (0.28 mole) of methacryloyl chloride was dissolved in 100 mL of 1,2-dichloroethane and added dropwise to the mixture in the flask. After complete addition and 3 hr of stirring, the triethylamine hydrochloride salt formed was filtered and the solution extracted with dilute sodium hydroxide in the cold, dilute hydrochloric acid, then given several water washes. The solution was dried over magnesium sulfate before evaporation of the solvent. The solid obtained was recrystallized from hexane. NMR and IR confirmed the structure of the compound and the absence of free hydroxyl groups; mp: 135° C.; Tg: 33°–35° C.

Preparation B 4,4'-isopropylidenebis(2,6-dichlorophenylene) acrylate:methacrylate 50:50

This monomer was prepared using the apparatus and procedure of Preparation A, with 51.25 g (0.14 mole) of 4,4'-isopropylidenebis(2,6-dichlorophenol), 14.64 g (0.14 mole) of methacryloyl chloride, 12.67 (0.14 mole) of acryloyl chloride and 29.5 g (0.29 mole) of triethylamine. The product was recrystallized from hexane; Tm: 103° C; Tg: 28°–29° C.

Preparation C 4,4'-isopropylidenebis(2,6-dimethylphenylene) dimethacrylate

This monomer was prepared using the apparatus and procedure of Preparation A from 18 g (0.063 mole) of 4,4'-isopropylidenebis(2,6-dimethylphenol), 13.23 g (0.126 mole) of methacryloyl chloride and 13.4 g of triethylamine.

Preparation D 4,4'-isopropylidenebis(2,6-dichlorophenylene) methacrylate:acetate 50:50

The monomer was prepared using the apparatus and procedure of Preparation A from 51.25 g (0.14 mole) of 4,4'-isopropylidenebis(2,6-dichlorophenol), 14.64 g (0.14 mole) of methacryloyl chloride, 10.99 g (0.14 mole) of acetyl chloride and 18 g of $Et_3N$. The product was recrystallized from hexane.

Preparation E

Electropolymerizable, amorphous mixture from 4,',4'-[benzo(c)furan-3-on-1-ylidene]bis(2,6-dibromophenol) (45 mole %) and 4,4'-isopropylidenebis(2,6-dibromophenol) (55 mole %) condensed with acryloyl chloride (50 mole %) and methacryloyl chloride (50 mole %)

The following materials were employed: 4,4'-[benzo(c)furan-3-on-1-ylidene]bis(2,6-dibromophenol), 39.37 g (0.0621 mole); 4,4'-isopropylidenebis(2,6-dibromophenol), 41.28 g (0.0759 mole); acryloyl chloride, 12.50 g (0.138 mole); methacryloyl chloride, 14.43 g (0.138 mole); and triethylamine, 30 g (0.297 mole).

The required amounts of the two bisphenols, acryloyl chloride and methacryloyl chloride were dissolved in approximately 600 mL of dichloromethane in a three-neck, round-bottomed flask. The solution was cooled to 0° C. using an ice-water mixture. A condenser fitted with a drying tube and a positive-pressure nitrogen system was used to keep moisture out of the reaction vessel.

The triethylamine dissolved in 100 mL of dichloromethane was added dropwise to the stirred solution in the reaction flask. After complete addition of the triethylamine, an additional one-tenth molar fraction of the stoichiomtric amount of acryloyl chloride was added to ensure complete reaction. The reaction was allowed to continue for 3 additional hr, at which time the precipitated salt was filtered off. The solution was subjected to the following extraction sequence.

(a) two dilute sodium hydroxide solution washes (2% cold);

(b) two dilute hydrochloric acid solution washes (4%);

(c) two distilled water washes.

The dichloromethane solution was then dried over magnesium sulfate. Hydroquinone (0.5 wt % of the starting bisphenol) was dissolved in 200 mL of ethanol and added to the solution.

Substantially all of the solvent was stripped off under vacuum at approximately 70° C.

To the dried amorphous monomer, 100 mL of ethanol and 25 mL of acetone were added. After thorough mixing, any remaining solid was filtered.

The solution was then added dropwise to 4 liters of distilled water in a Waring blender for precipitation of the product.

The precipitation can be repeated as many times as deemed necessary for adequate purification. The isolated monomer was air-dried at ambient temperature to yield a very fine powder. Tg=59° C.

EXAMPLE 1

This illustrates an electrically photosensitive material containing electropolymerizable monomers in accordance with the present invention.

The following solvent-containing, electrically photosensitive material was coated at 3.4 g/m$^2$, dry coverage, on a chromium/silicon monoxide conductive layer on a polyester support to form a donor element:

| Component | Name or Structure | Total % by Weight |
|---|---|---|
| electrically photosensitive colorant | 2-{3-[1-ethyl-2(1H)—quinolinylidene]-1-propenyl}-6-[2-(1,2,3,4-tetrahydro-1,2-dimethyl-6-quinolinyl)ethenyl]-4H—pyran-4-ylidene-propane dinitrile | 1.68 |
| electropolymerizable monomers: | (A) 4,4'-isopropylidene-bis(2,6-dichlorophenylene) acrylate:methacrylate (50:50) | 8.05 |
| | (B) 4,4'-isopropylidene-bis(2,6-dichlorophenylene) acrylate:propionate | 7.89 |
| carrier polymer | poly(octadecyl acrylate) | 7.89 |
| charge-control polymer | poly(t-butylstyrene-co-lithium methacrylate) 97/3 | 1.01 |
| sensitizer | 4,4',4''-trimethoxytriphenylamine | 0.17 |
| solvent | 1,1,1-trichloroethane | 73.15 |

The receiver element employed with the above donor was prepared by coating 11 grams/m$^2$ of the polyurethane on a conductive support, followed by a 2.23 g/m$^2$ overcoat comprising the polyester poly(2,2-dimethyl-1,3-propylene sebacate-co-t-butylisophthalate 30:70).

EXAMPLE 2

This illustrates an electrically photosensitive material of the present invention containing ultraviolet curing agents in addition to the electropolymerizable monomers.

The electrically photosensitive material of Example 1 was modified in the following respects: copper phthalocyanine replaced the Example 1 colorant, and the UV curing sensitizer 3-(2-benzofuroyl)-7-diethylaminocoumarin and ethyl p-dimethylaminobenzoate activator were incorporated into the solvent-containing material in concentrations of 0.3% and 1.2%, respectively, based on the monomer weight.

EXAMPLE 3

This illustrates electrohardening of the electrically photosensitive material in Example 1. The donor and blocking elements were contacted to form a migration imaging unit and subjected to an 800-volt negative field bias on the donor at 67° C. Time of field exposure ranged from 0.2 to 7.6 sec. No light was employed.

Processed areas on the donor were tested for scratch resistance and solubility change in 1,1,1-trichloroethane. (In this solvent, colorant and electrohardened constituents are insoluble.) Solubility change was determined by measuring the transmission density of the processed area before ($D_b$) and after ($D_a$), a 1-min immersion in 1,1,1-trichloroethane. The ratio $D_a/D_b$, an indication of decrease in solubility as a result of electric-field hardening, was thereafter calculated. For ideal materials, a $D_a/D_b$ of 1.0 indicates a highly electropolymerized material, while a $D_a/D_b$ of less than 0.30 indicates insufficient electropolymerization.

Scratch resistance was determined using an Arco Microknife TM, Model No. AG-2950 (available from Gardner Laboratory Division of Pacific Scientific Co., Bethesda, Md. The cutting tool in this device was a stylus having a rounded point of 3-mil radius. Scratch resistance was determined as the stylus load in grams required to cause loss of information as the stylus rode on the surface of alphameric text material.

The results are shown in Table 1.

TABLE 1

| Time of Exposure to Electric Field (seconds) | Transmission Density $D_b$ | $D_a$ | $D_a/D_b$ | Scratch Resistance (grams) |
|---|---|---|---|---|
| 0.2 | 0.30 | 0.09 | 0.30 | $D_a$ too low |
| 0.4 | 0.24 | 0.09 | 0.37 | 100–150 |
| 0.7 | 0.34 | 0.15 | 0.44 | 150–200 |
| 1.0 | 0.80 | 0.38 | 0.48 | 150–200 |
| 2.1 | 1.00 | 0.52 | 0.52 | 150–200 |
| 4.6 | 1.07 | 0.70 | 0.65 | 150–200 |
| 7.6 | 0.98 | 0.68 | 0.69 | 200–250 |

EXAMPLE 4

This illustrates electrohardening of the material in Example 2 using the procedure of Example 3, varying the applied field voltage and current density. All processing was done in the absence of light and for a field exposure of 1–2 sec.

Scratch resistance and solubility change results are shown in Table 2.

TABLE 2

| Applied Field* (volts) | Current Density ($\mu A/cm^2$) | Transmission Density $D_b$ | $D_a$ | $D_a/D_b$ | Scratch Resistance (grams) |
|---|---|---|---|---|---|
| 0 | — | 1.19 | 0.00 | 0.00 | 30 |
| 100 | 0.2 | 0.34 | 0.01 | 0.03 | 100–150 |
| 200 | 1.4 | 0.44 | 0.11 | 0.25 | 150–200 |
| 300 | 0.6 | 0.68 | 0.24 | 0.35 | 200 |
| 400 | 0.6 | 0.86 | 0.31 | 0.36 | 200 |
| 500 | 1.0 | 1.09 | 0.40 | 0.37 | 200 |
| 600 | 1.0 | 1.09 | 0.39 | 0.36 | 200–250 |
| 700 | 3.0 | 1.34 | 0.56 | 0.42 | 200–250 |
| 800 | 4.0 | 1.38 | 0.69 | 0.50 | 200–250 |
| 900 | 3.5 | 1.42 | 0.73 | 0.51 | 200–250 |
| 1000 | 5.5 | 1.40 | 0.87 | 0.62 | 200–250 |

*The donor and receiver element through which the field was applied had a combined thickness of about 15 micrometers.

EXAMPLE 5

This illustrates a migration imaging process using the donor and receiver elements described in Example 1.

Images are formed by heating the donor and receiver elements in intimate contact for approximately 2 sec at 80° C. A negative potential of 800 to 1000 volts is applied between the two films, followed by an optical exposure of approximately 2000 ergs/cm$^2$ for 1 sec, through the donor film support. The elements are separated while the electric field is still on, and allowed to cool. A negative image appears on the blocking element and a corresponding positive image appears on the donor element.

Although the invention has been described in considerable detail with particular reference to certain preferred embodiments thereof, variations and modifications can be effected within the spirit and scope of the invention.

We claim:

1. An electrically photosensitive material comprising electrically photosensitive colorant particles dispersed in a liquefiable, electrically insulating carrier containing a polymeric binder and an electropolymerizable bisphenol-acrylate monomer.

2. An electrically photosensitive material as in claim 1 wherein said bisphenol-acrylate monomer has the structural formula:

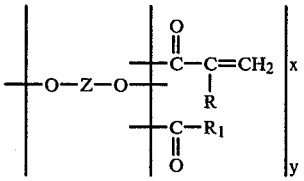

wherein:

Z, together with the oxygen atoms to which it is attached, is the residue of a bisphenol;

R is hydrogen or methyl;

$R_1$, together with the:

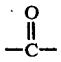

to which it is attached, is an acyl group;

x is 1 or 2;

y is 0 or 1; and x+y is 2;

3. An electrically photosensitive material comprising electrically photosensitive colorant particles dispersed in a liquefiable, electrically insulating carrier containing a polymeric binder and an electropolymerizable monomer or a mixture of two or more of such monomers having the structural formula:

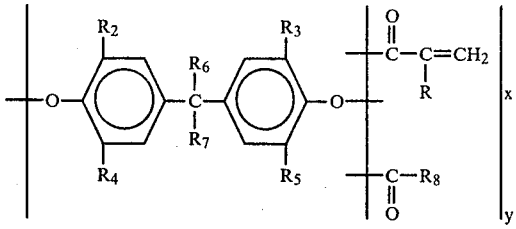

wherein:

R is hydrogen or methyl;

$R_8$ is 1–6 carbon alkyl or cycloalkyl, phenyl, benzyl, halogenated phenyl or halogenated benzyl;

x is 1 or 2, y is 0 or 1; and x+y is 2;

each of $R_2$, $R_3$, $R_4$ and $R_5$ is independently 1–4 carbon alkyl or halogen; and each of $R_6$ and $R_7$ is independently hydrogen, 1–6 carbon alkyl or, when taken together with the carbon atom to which they are attached, form a divalent, monocyclic or polycyclic aromatic, alicyclic or heterocyclic group.

4. The electrically photosensitive material of claim 3 wherein said monomer is selected from the group consisting of 4,4'-isopropylidenebis(2,6-dichlorophenylene) diacrylate, 4,4'-isopropylidenebis(2,6-dichlorophenylene) monoacrylate:monomethacrylate, 4,4'-isopropylidenebis(2,6-dichlorophenylene) dimethacrylate, 4,4'-isopropylidenebis(2,6-dimethylphenylene) dimethacrylate, 4,4'-isopropylidenebis(2,6-dichlorophenylene) monocyclohexanecarboxylate:monoacrylate, 4,4'-(9-fluorenylidene)bis(2,6-dichlorophenylene) monoacrylate:monomethacrylate, 4,4'-[benzo(d)furan-3-on-1-ylidene]bis(2,6-dibromophenylene) diacrylate and 4,4-[benzo(d)furan-3-on-1-ylidene]bis(2,6-dibromophenylene) monoacrylate:monomethacrylate.

5. The electrically photosensitive material of claim 4 wherein said polymeric binder is a polyester having recurring units of the structure:

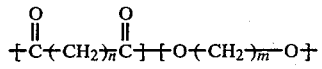

wherein n and m are the same or different, and each is an integer of 11 or more.

6. The electrically photosensitive material of claim 4 wherein said polymeric binder is poly(docosyl acrylate), poly(docosyl acrylate-comethyl acrylate), poly(vinyl stearate), poly(octadecyl acrylate), poly(hexadecamethylene hexadecanedioate), poly(vinylphenyl stearate), poly(vinylphenyl methacrylate-co-vinylphenyl stearate), poly[4,4'-isopropylidenebis(2,6-dichlorophenylene) undecanedioate] and poly(vinylphenyl methacrylate-co-vinylbenzyl myristate).

7. The electrically photosensitive material of claim 5 wherein said carrier has a conductivity of less than $1\times10^{-10}$ (ohm-cm)$^{-1}$.

8. The electrically photosensitive material of claim 7 wherein said colorant is a merocyanine-cyanine-merocyanine colorant.

9. A photoelectrophoretic process comprising:

(a) providing an electrically photosensitive material comprising electrically photosensitive colorant particles dispersed in a liquefiable, electrically insulating carrier containing a polymeric binder and an electropolymerizable bisphenol-acrylate monomer, (b) subjecting said material to an imagewise exposure of actinic radiation and an electric field to cause imagewise migration of said colorant particles within said material and (c) subjecting said material to a sufficient electric field to cause said material to harden during or after colorant migration.

10. The process of claim 9 wherein the strength of the electric field in step (c) is at least $6\times10^4$ volts/cm and the current density sufficient to produce hardening is at least 0.2 $\mu A/cm^2$.

11. The process of claim 9 or 10 wherein said bisphenol-acrylate monomer has the structural formula:

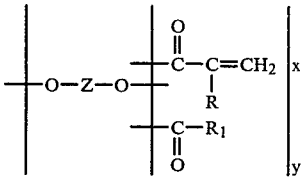

wherein:

Z, together with the oxygen atoms to which it is attached, is the residue of a bisphenol;

R is hydrogen or methyl;

$R_1$, together with the:

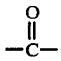

to which it is attached, is an acyl group;

x is 1 or 2;

y is 0 or 1; and x+y is 2;

12. The process of claims 9 or 10 wherein said monomer has the structural formula:

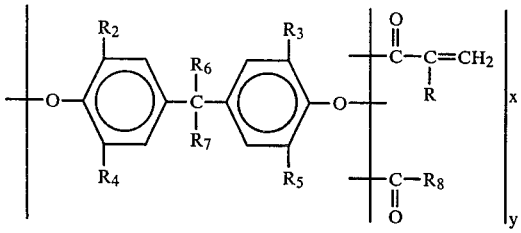

wherein:

R is hydrogen or methyl;

$R_8$ is 1–6 carbon or alkyl or cycloalkyl, phenyl, benzyl, halogenated phenyl or halogenated benzyl;

x is 1 or 2;

y is 0 or 1; and x+y is 2;

each of $R_2$, $R_3$, $R_4$ and $R_5$ is independently 1–4 carbon alkyl or halogen; and each of $R_6$ and $R_7$ is independently hydrogen, 1–6 carbon alkyl or, when taken together with the carbon atom to which they are attached, form a divalent, monocyclic or polycyclic, aromatic, alicyclic or heterocyclic group.

13. The process of claims 9 or 10 wherein said monomer is selected from the group consisting of 4,4'-isopropylidenebis(2,6- dichlorophenylene) diacrylate, 4,4'-isopropylidenebis(2,6-dichlorophenylene) monoacrylate:monomethylacrylate, 4,4'-isopropylidenebis(2,6-dichlorophenylene) dimethacrylate, 4,4'-isopropylidenebis(2,6-dimethylphenylene) dimethacrylate, 4,4'-isopropylidenebis(2,6-dichlorophenylene) monocyclohexanecarboxylate:monoacrylate, 4,4'-(9-fluorenylidene)bis(2,6-dichlorophenylene) monoacrylate:monomethacrylate, 4,4'-[benzo(d)furan-3-on-1-ylidene]bis(2,6-dibromophenylene) diacrylate and 4,4-[benzo(d)furan-3-on-1-ylidene]bis(2,6-dibromophenylene) monoacrylate:monomethacrylate.

14. The process of claim 13 wherein said polymeric binder is a polyester having recurring units of the structure:

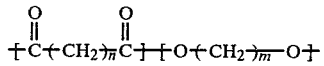

wherein n and m are the same or different, and each is an integer of 11 or more.

15. The process of claim 12 wherein said polymeric binder is poly(docosyl acrylate), poly(docosyl acrylate-co-methyl acrylate), poly(vinyl stearate), poly(octadecyl acrylate), poly(hexadecamethylene hexadecanedioate), poly(vinylphenyl stearate), poly(vinylphenyl methacrylate-co-vinylphenyl stearate), poly[4,4'-isopropylidenebis(2,6-dichlorophenylene) undecanedioate] and poly(vinylphenyl methacrylate-co-vinylbenzyl myristate).

16. The process of claim 14 wherein said carrier has a conductivity of less than $1\times10^{-10}$ (ohm-cm)$^{-1}$.

17. The process of claim 16 wherein said colorant is a merocyanine-cyanine-merocyanine colorant.

* * * * *